United States Patent [19]

Walter

[11] Patent Number: 4,850,846

[45] Date of Patent: Jul. 25, 1989

[54] APPARATUS FOR HOT PRESSING MATS USED IN THE MANUFACTURE OF CHIPBOARD, FIBERBOARD AND SIMILAR PRESSED BOARD

[75] Inventor: Karl Walter, Kempen, Fed. Rep. of Germany

[73] Assignee: G. Siempelkamp GmbH & Co., Krefeld, Fed. Rep. of Germany

[21] Appl. No.: 216,144

[22] Filed: Jul. 7, 1988

[30] Foreign Application Priority Data

Jul. 31, 1987 [DE] Fed. Rep. of Germany ..... 3725383

[51] Int. Cl.[4] ..... B27N 3/24; B30B 5/06

[52] U.S. Cl. ..... 425/337; 100/152; 156/583.5; 425/371

[58] Field of Search ..... 100/151, 152; 156/39, 156/62.2, 555, 583.5; 264/113; 425/329, 335, 337, 363, 371, 373; 426/502

[56] References Cited

U.S. PATENT DOCUMENTS

| | | | |
|---|---|---|---|
| 1,270,096 | 6/1918 | Baker | 425/371 |
| 2,490,381 | 12/1949 | Shields | 100/151 |
| 3,168,056 | 2/1965 | Engels | 425/371 |
| 4,410,380 | 10/1983 | Ahrweiler et al. | 156/62.2 |
| 4,517,148 | 5/1985 | Churchland | 156/583.5 |
| 4,731,008 | 3/1988 | Hayashi et al. | 425/335 |
| 4,744,854 | 5/1988 | Schenz | 156/583.5 |

FOREIGN PATENT DOCUMENTS

| | | | |
|---|---|---|---|
| 0128015 | 12/1984 | European Pat. Off. | 425/371 |
| 1201048 | 9/1965 | Fed. Rep. of Germany | 156/583.5 |
| 2247990 | 4/1974 | Fed. Rep. of Germany | 425/371 |
| 0544663 | 5/1957 | Italy | 156/62.2 |

*Primary Examiner*—Michael W. Ball
*Assistant Examiner*—Steven D. Maki
*Attorney, Agent, or Firm*—Herbert Dubno

[57] ABSTRACT

The apparatus for hot pressing a pressed board mat used in making chipboard panels, fiberboard panels and pressed board panels comprises a continuously operating press with a lower press belt and an upper press belt and a conveyor with at least two endless conveyor belts adjoining each other. The press has a mouth entrance in which the conveyor extends with a delivery nose directed in the feed direction up to a delivery region in the entrance. The delivery nose is movable in the vertical direction, in the transport direction and in a direction opposite to the transport direction and because of that, the delivery region is displaceable in the entrance of the press according to the thickness of the pressed board mat to be pressed.

6 Claims, 2 Drawing Sheets

APPARATUS FOR HOT PRESSING MATS USED IN THE MANUFACTURE OF CHIPBOARD, FIBERBOARD AND SIMILAR PRESSED BOARD

FIELD OF THE INVENTION

My invention relates to an apparatus used in the manufacture of chipboard, fiberboard and the like pressed board (generally: particle board) and, more particularly, to an apparatus for hot pressing mats used to make chipboard, fiberboard and other forms of pressed board.

BACKGROUND OF THE INVENTION

An apparatus for hot pressing a pressed board mat in the manufacture of a chipboard, fiberboard and/or pressed board panels can comprise a continuously operating press with a lower press belt and an upper press belt and a conveyor with at least two endless conveyor belts adjoining each other.

The press has an entrance or mouth into which the conveyor extends with a delivery nose directed in the feed direction up to a delivery region between the delivery nose and the lower press belt of the press. The pressed board panel can also comprise a laminate.

A conveyor belt of the conveyor can be guided over the delivery nose.

Apparatuses of this type are constructed so that pressed board mats of differing thickness can be fed into the entrance and can be pressed to chipboard panels and/or fiberboard panels and/or laminate panels and the like of different thickness. Moreover the entire upper portion of the press can be adjusted or equipped according to the different sizes of the press gap width.

In the apparatus described in German Patent No. 31 19 529 and German Patent No. 34 32 548, the delivery nose is fixed.

The delivery region is a fixed region in which the pressed board mat to be pressed is delivered from the delivery nose to the lower press belt.

The entrance has a large size compared to the press gap size which is constricted in the feed direction until at the press gap. The entrance is heated or becomes heated in operation of the unit. That is especially true for the press belts.

Since the delivery region is fixed that means that the lower side of a pressed board mat to be pressed under the circumstances is in contact with an associated hot press belt longer than the upper side.

The setting or hardening process in the pressed board in such a case begins sooner on the lower side than on the upper side which according to the particular pressed board composition and dimensions can lead to an impairment in the quality of the lower side of the finished pressed board panel and may make an abrasive treatment of the lower side necessary to correct blemishes.

OBJECTS OF THE INVENTION

It is an object of my invention to provide an improved apparatus for hot pressing a pressed board mat in the manufacture of chipboard panels, fiberboard panels or the like pressed board panels which do not have the above-mentioned disadvantage.

It is another object of my invention to provide an improved apparatus for hot pressing a pressed board mat in the manufacture of chipboard panels, fiberboard panels or the like pressed board panels with which it is guaranteed that the upper and lower sides of a pressed board panel have nearly the same setting or hardening time.

It is also an object of my invention to provide an improved apparatus for hot pressing a pressed board mat in the manufacture of chipboard panels, fiberboard panels or the like pressed board panels in which the pressed board upper and lower sides come into contact with the associated press belts practically simultaneously.

SUMMARY OF THE INVENTION

These objects and others which will become more readily apparent hereinafter are attained, in accordance with my invention, in an apparatus for hot pressing a pressed board mat in the manufacture of a chipboard, fiberboard or other types of pressed board, comprising a continuously operating press with a lower press belt and an upper press belt and a conveyor with at least two endless conveyor belts adjoining each other. The press has a mouth in which the conveyor extends with a delivery nose directed in the feed direction until in a delivery region between the delivery nose and the lower press belt of the press.

According to my invention, the delivery nose is movable in a vertical direction, in a transport direction and in a direction opposite to the transport direction and because of that, the delivery region is displaceable in the mouth of the press according to the thickness of the pressed board mat to be pressed.

The displacement is effected so that with thin pressed board mats the delivery nose extends further into the entrance than it does with thick pressed board mats and, of course, so that the pressed board lower side and upper side come into contact practically simultaneously with the associated press belts and consequently the lower side and the upper side are simultaneously heated so that the setting and hardening process proceeds simultaneously.

The displacement is performed with the apparatus according to my invention, in pressing a pressed board mat of a predetermined thickness and can be effected by hand or automatically according to a program.

There are different forms and structures which can fall within the ambit of my invention. In one embodiment of my invention, the delivery nose is positioned in an independent delivery section and this delivery section is pivotable about its connecting point to the adjacent upstream conveyor belt.

That means that the adjustment of the delivery nose in the vertical direction is effected along an arc which is defined by the pivot point and the length of the independent conveyor section. To move the delivery nose in the transport direction and back, the conveyor section is provided with an inwardly and outwardly movable tablet about which the conveyor belt runs over and also a length compensating loop. Since the delivery nose on its end has a small however finite radius of curvature, a small gap arises between the delivery nose and the associated press belt.

According to the pressed board, it my be desirable to bridge this gap. Thus my invention teaches that a bridging plate should be positioned in the delivery region it bridges the gap between the delivery nose and the press belt. The bridging plate can adjoin the delivery nose or be connected to it and can be movable with it.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
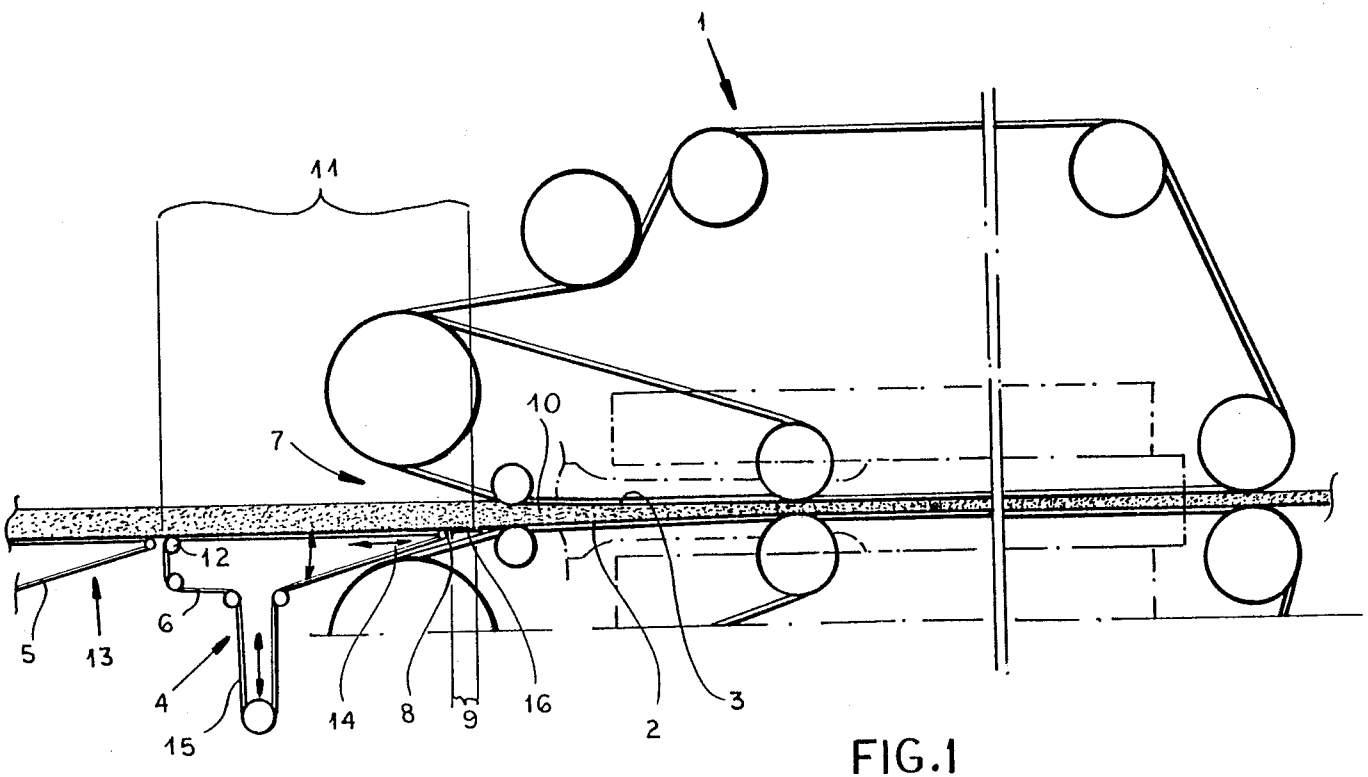
FIG. 1 is a schematic side-elevational view of an apparatus for hot pressing mats in the making of particle board according to my invention.

The apparatus shown in the drawing is used for hot pressing pressed board mats used in the manufacture of chipboard, fiberboard and similar pressed board pieces or panels. It basically comprises a continuously operating press 1 with a lower press belt 2 and an upper press belt 3 and a conveyor 4 with endless conveyor belts 5 and 6 adjoining each other.

The press 1 has a mouth 7 which was drawn with an exaggerated large size to clearly illustrate the essential features of the invention. The conveyor 4 is inserted with a delivery nose 8 directed in the feed direction into the entrance 7 and of course up to a delivery region 9 between the delivery nose 8 and the lower press belt 2 of the press 1.

Figure 2:
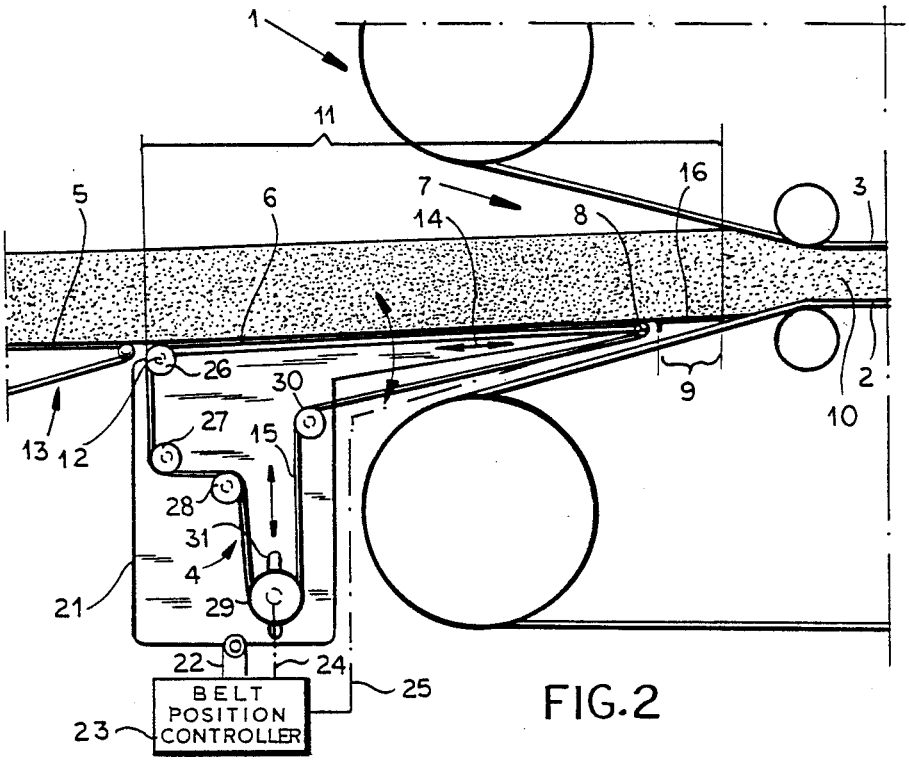
FIG. 2 is an enlarged side-elevational view of a front portion of the apparatus shown in FIG. 1.
Figure 3:
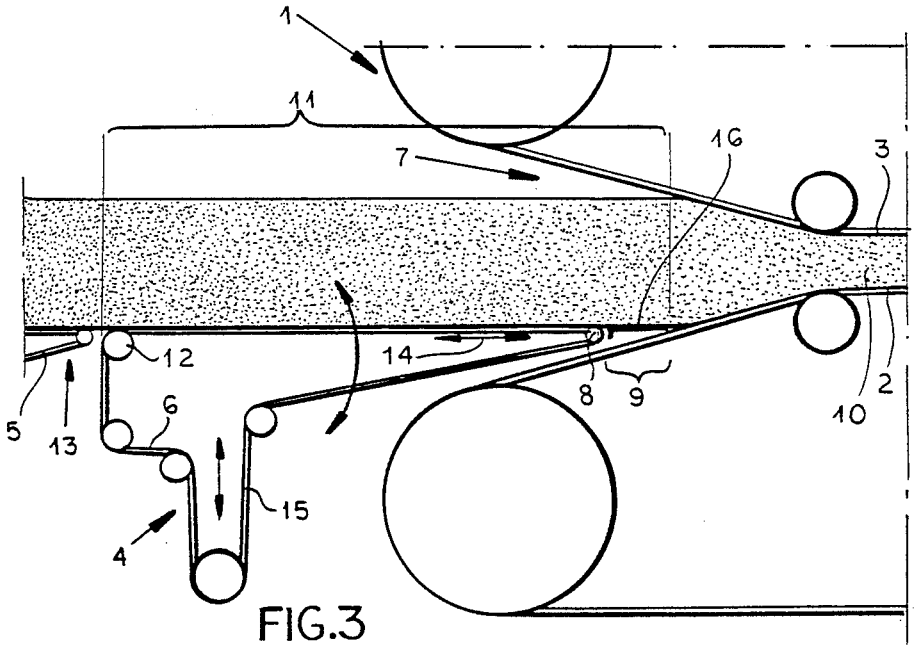
FIG. 3 is an enlarged side-elevational view of the front portion of the apparatus shown in FIG. 2 in a different operating configuration.

As can be seen from FIGS. 2 and 3, the delivery nose 8 is movable in the vertical direction and in the feed direction and back (as shown by the arrows) and, of course, so that the delivery region 9 is displaced in the entrance 7 according to the thickness of a pressed board mat 10 to be pressed.

Moreover the delivery nose 8 is provided in an independent conveyor section 11 and this conveyor section 11 is pivotable about its connecting point 12 with the upstream conveyor 13.

The motion of the delivery nose 8 in the vertical direction is effected thus along an arc which however has a large radius of curvature.

The conveyor section 11 is also provided with an inwardly and outwardly movable tablet represented by arrow 14 about which the conveyor belt 6 of this conveyor section 11 is guided. The conveyor belt 6 also runs over a length compensating loop 15.

A bridge plate 16 which bridges a gap between the delivery nose 8 and the press belt 2 is located in the delivery region 9. It may be connected to the delivery nose 8 and is movable with it.

The tablet 14 and nose 8 can be guided on plate 21 (one of which has been shown) pivotable about the axis 12 of the roller 26 which is one of the guide rollers 26 - 30 of the belt 4. In addition, the loop 15 can be adjusted by the movement of roller 29 in slot 31. A belt position controller 23 is pivotally connected to the plates 21 by link 22, to the roller 29 by link 25 to adjust the delivery unit as described.

By comparing FIGS. 2 and 3, one sees that the delivery nose 8 projects less far into the entrance 7 with pressed board mats 10 of larger thickness than with pressed board mats of smaller thickness. The displacement of the delivery nose 8 is effected continuously so that the pressed board upper side and lower side comes into contact practically simultaneously with the associated press belt 2 and/or 3.

I claim:

1. In an apparatus for hot pressing a pressed board mat in the manufacture of a particleboard, comprising a continuously operating press with a lower press belt and an upper press belt and a conveyor with at least two endless conveyor belts adjoining each other, said press having a mouth and said conveyor extending into said mouth with a delivery nose directed in a feed direction up to a delivery region between said delivery nose and said lower press belt of said press, the improvement wherein said delivery nose is movable in a vertical direction, in a transport direction and in a direction opposite to said transport direction whereby said delivery region is displaceable in said mouth in accordance with the thickness of said pressed board mat such that the pressed board mat contacts said lower press belt and said upper press belt practically simultaneously.

2. The improvement defined in claim 1 wherein said delivery nose is located in an independent conveyor section and said conveyor section is pivotable about a connecting point to an upstream one of said conveyors.

3. The improvement defined in claim 2 wherein said conveyor section has an inwardly and outwardly movable tablet about which a conveyor belt of said independent conveyor section is guided and said conveyor belt moreover runs over a length compensating loop.

4. The improvement defined in claim 1, further comprising a bridging plate which bridges a gap between said delivery nose and said lower press belt located in said delivery region.

5. The improvement defined in claim 4 wherein said bridging plate is connected to said delivery nose and is movable with said delivery nose.

6. An apparatus for hot pressing a pressed board mat in the manufacture of a particle board comprising:

a continuously operating press with a lower press belt and an upper press belt and a mouth;

a conveyor with at least two endless conveyor belts adjoining each other and with at least one independent conveyor section, said conveyor extending into said mouth with a delivery nose of said independent conveyor section up to a delivery region between said delivery nose and said lower press belt of said press and said delivery nose in said independent conveyor section being movable in a vertical direction, in a transport direction and in a direction opposite to said transport direction and being displaceable in said mouth in accordance with the thickness of said pressed board mat such that the pressed board mat contacts said lower press belt and said upper press belt practically simultaneously, said independent conveyor section being pivotable about a connecting point to the adjacent upstream on of said conveyor belts and said independent conveyor section having an inwardly and outwardly movable tablet about which one of said conveyor belts which also runs over a length compensating loop is guided; and a bridging plate which bridges a gap between said delivery nose and said lower press belt located in said delivery region, which is connected to said delivery nose and which is movable with said delivery nose.

* * * * *